US012345035B2

(12) United States Patent
Ahola et al.

(10) Patent No.: US 12,345,035 B2
(45) **Date of Patent: *Jul. 1, 2025**

(54) TOILET WITH NON-VITREOUS FLUSH ENGINE

(71) Applicant: Kohler Co., Kohler, WI (US)

(72) Inventors: Billy Jack Ahola, Manitowoc, WI (US); Andrew L. Smith, Sheboygan, WI (US); Mark E. Baumgartner, Sheboygan, WI (US); Donald G. Bogenschuetz, Sheboygan, WI (US); Tobin J. Vetting, Sheboygan Falls, WI (US); Lawrence E. Duwell, Plymouth, WI (US); Peter W. Swart, Oostburg, WI (US)

(73) Assignee: Kohler Co., Kohler, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/523,041

(22) Filed: Nov. 29, 2023

(65) Prior Publication Data

US 2024/0093476 A1 Mar. 21, 2024

Related U.S. Application Data

(63) Continuation of application No. 17/513,514, filed on Oct. 28, 2021, now Pat. No. 11,866,921, which is a (Continued)

(51) Int. Cl.

| | |
|---|---|
| ***E03D 11/13*** | (2006.01) |
| ***E03D 1/26*** | (2006.01) |
| ***E03D 11/02*** | (2006.01) |

(52) U.S. Cl.

CPC ..... *E03D 11/13* (2013.01); *E03D 1/26* (2013.01); *E03D 11/02* (2013.01)

(58) Field of Classification Search

CPC .... E03D 1/26; E03D 1/30; E03D 1/01; E03D 1/012; E03D 5/012; E03D 11/02; (Continued)

(56) References Cited

U.S. PATENT DOCUMENTS

| | | | |
|---|---|---|---|
| 231,687 | A | 8/1880 | Smith |
| 2,749,968 | A | 6/1956 | Suser |

(Continued)

FOREIGN PATENT DOCUMENTS

| | | | |
|---|---|---|---|
| CN | 1532353 | A | 9/2004 |
| CN | 102776934 | A | 11/2012 |

(Continued)

OTHER PUBLICATIONS

Chinese Office Action for Chinese Application No. 201980052561.7, dated Dec. 2, 2021.

(Continued)

*Primary Examiner* — Erin Deery

(74) *Attorney, Agent, or Firm* — Lempia Summerfield Katz LLC

(57) ABSTRACT

A toilet assembly includes a flush engine having a bowl defining a sump and a trapway extending from the sump. A bowl insert is configured to be located in the bowl and a shroud is configured to be positioned over the flush engine to conceal at least a portion of the flush engine.

18 Claims, 7 Drawing Sheets

Related U.S. Application Data continuation of application No. 16/533,334, filed on Aug. 6, 2019, now Pat. No. 11,180,910.

(60) Provisional application No. 62/715,431, filed on Aug. 7, 2018.

(58) Field of Classification Search
CPC ..... E03D 11/06; E03D 11/18; E03D 11/13; E03D 3/10; E03D 11/00
See application file for complete search history.

(56) References Cited

U.S. PATENT DOCUMENTS

| | | | | |
|---|---|---|---|---|
| 3,262,132 | A | 7/1966 | Mann | |
| 3,843,977 | A | 10/1974 | Garnett | |
| 3,965,493 | A | 6/1976 | Bemis | |
| 4,041,554 | A | 8/1977 | Gregory et al. | |
| 4,144,903 | A | 3/1979 | Gregory et al. | |
| 4,145,772 | A | 3/1979 | Whitney et al. | |
| 4,195,374 | A | 4/1980 | Hafner et al. | |
| 4,237,934 | A | 12/1980 | Brian et al. | |
| 5,231,706 | A | 8/1993 | Kendall | |
| 5,909,968 | A | 6/1999 | Olin et al. | |
| 6,212,700 | B1 | 4/2001 | Giesler et al. | |
| 7,757,312 | B2 * | 7/2010 | Stack | E03D 11/00 4/427 |
| 7,861,331 | B2 | 1/2011 | Grech et al. | |
| 8,191,182 | B2 | 6/2012 | Mauduit | |
| 8,276,218 | B2 | 10/2012 | Grech | |
| 2005/0115042 | A1 | 6/2005 | Davies et al. | |
| 2009/0019630 | A1 | 1/2009 | Bernabei et al. | |
| 2014/0208498 | A1 | 7/2014 | Beach et al. | |
| 2014/0259350 | A1 | 9/2014 | Davis et al. | |
| 2014/0259351 | A1 | 9/2014 | Spankowski et al. | |
| 2015/0267388 | A1 | 9/2015 | Bhardwaj et al. | |
| 2018/0112383 | A1 | 4/2018 | Le | |

FOREIGN PATENT DOCUMENTS

| | | | | |
|---|---|---|---|---|
| CN | 204876009 | U | 12/2015 | |
| CN | 107975122 | A | 5/2018 | |
| CN | 108286285 | A | 7/2018 | |
| EP | 2876221 | A1 * | 5/2015 | E03D 1/01 |
| JP | 2603698 | B2 | 2/1990 | |
| JP | 7005499 | A | 1/1995 | |
| JP | H09144115 | A | 6/1997 | |
| JP | H09158285 | A | 6/1997 | |
| JP | H11107344 | A | 4/1999 | |
| JP | 4720680 | B2 | 3/2008 | |
| WO | 8603241 | A1 | 6/1986 | |
| WO | 2006096947 | A3 | 11/2006 | |
| WO | 2014066187 | A1 | 5/2014 | |

OTHER PUBLICATIONS

International Search Report and Written Opinion re Application No. PCT/US19/45312; 11 pgs.

* cited by examiner

TOILET WITH NON-VITREOUS FLUSH ENGINE

CROSS-REFERENCE TO RELATED PATENT APPLICATIONS

This application is a Continuation of U.S. patent application Ser. No. 17/513,514 filed Oct. 28, 2021, which is a Continuation of U.S. patent application Ser. No. 16/533,334 filed Aug. 6, 2019, which claims priority to and the benefit of U.S. Provisional Patent Application No. 62/715,431, filed Aug. 7, 2018, the entire disclosures of which are incorporated herein by reference.

BACKGROUND

The present application relates generally to the field of toilet assemblies having vitreous and non-vitreous components. More specifically, the present application relates to toilet assemblies having a vitreous bowl and a vitreous shroud coupled to a non-vitreous (e.g., plastic) flush engine.

Conventionally, whenever a new toilet is developed, the waterways within the toilet must be re-engineered to fit within the shape of the new toilet. For example, a waste trapway must be redesigned to fit within a new pedestal design based on the desired aesthetics. Specifically, the design for the waste trapway goes through multiple iterations in order to optimize the suction power during a flush cycle while minimizing water consumption. This re-engineering process increases the development costs for new products.

A conventional toilet can also be costly to develop due to the use of vitreous china, which provides a sanitary surface. Importantly, this sanitary surface minimizes or eliminates the presence of bacteria, waste, or other harmful chemicals being retained on the surface. However, vitreous china requires casting and firing, utilizing a manufacturing process specially developed for each new toilet design, which increases both prototyping costs and overall manufacturing costs.

In order to reduce development costs of a new toilet design, it may be advantageous to provide a standardized flush engine, which may be coupled to a vitreous bowl insert and/or enclosed in vitreous shrouds having different shapes.

SUMMARY

One embodiment relates to a toilet assembly, including a flush engine having a bowl defining a sump and a trapway extending from the sump. A bowl insert is configured to be located in the bowl and a shroud is configured to be positioned over the flush engine to conceal at least a portion of the flush engine.

One aspect of the toilet assembly relates to the flush engine being from a material that is not vitreous china.

One aspect of the toilet assembly relates to the bowl insert and the shroud both being formed from a material that is vitreous china.

One aspect of the toilet assembly relates to an overflow rim of the flush engine at an upper periphery of the bowl.

Another aspect of the toilet assembly relates to an overflow nozzle of the flush engine extending from the overflow rim and configured to pass excess water from the overflow rim to the trapway such that the excess water bypasses the bowl.

Another aspect of the toilet assembly relates to the bowl insert comprising a lip extending laterally outward from an upper periphery of the bowl insert, the lip of the bowl insert configured to engage the overflow rim when the bowl insert is received within the bowl.

Another aspect of the toilet assembly relates to the overflow rim comprises a first portion extending laterally outward from the upper periphery of the bowl and a second portion extending vertically upward from the first portion. The lip of the bowl insert is spaced apart from the second portion of the overflow rim to define a channel that provides an area for excess water to flow between the lip and the second portion of the overflow rim.

Another aspect of the toilet assembly relates to a rinse rim configured to be coupled to a top portion of the flush engine, the rinse rim defining a plurality of rinse openings configured to supply water from within the rinse rim into the bowl insert.

Another aspect of the toilet assembly relates to the trapway extending from the sump at a trapway inlet of the trapway, and the bowl insert defining a trapway opening configured to align with the trapway inlet of the trapway when the bowl insert is received in the bowl.

Another aspect of the toilet assembly relates to the flush engine comprising a sump nozzle extending from the sump of the bowl and the bowl insert defining a sump opening configured to align with the sump nozzle of the flush engine when the bowl insert is received in the bowl.

Another aspect of the toilet assembly relates to the bowl insert being located within the bowl of the flush engine such that the bowl does not directly hold any fluid.

Another embodiment relates to a flush engine for a toilet, including a bowl defining a sump and configured to receive a bowl insert, and a trapway extending from the sump. The flush engine further includes an overflow rim at an upper periphery of the bowl. The overflow rim is configured to engage a lip of the bowl insert received in the bowl.

One aspect of the flush engine relates to the bowl and the trapway being formed from a material that is not a vitreous china.

Another aspect of the flush engine relates to flush engine being configured to be at least partially received within various shrouds having different external aesthetics.

Another aspect of the flush engine relates to an overflow nozzle extending from the overflow rim and configured to pass excess water from the overflow rim to the trapway such that the excess water bypasses the bowl.

Another aspect of the flush engine relates to an overflow trapway that fluidly connects the overflow nozzle and the trapway.

Another embodiment relates to a method of assembling a toilet assembly, including providing a flush engine having a bowl defining a sump, and a trapway extending from the sump. The method further includes inserting a bowl insert into the bowl. The method further includes positioning a shroud over the flush engine to conceal at least a portion of the flush engine.

One aspect of the method relates to where the flush engine is formed from a material that is not a vitreous china, and the bowl insert and the shroud are both formed from a material that is vitreous china.

One aspect of the method relates to the shroud being a first pedestal shroud and further including removing the first pedestal shroud from the flush engine and positioning a second pedestal shroud over the flush engine, the second pedestal shroud having a different aesthetic appearance from the first pedestal shroud.

Another aspect of the method relates to coupling a rinse rim to the flush engine, providing a tank having a conduit defining a rinse outlet and a separate sump outlet, fluidly coupling the rinse outlet to the rinse rim, and fluidly coupling the sump outlet to the sump.

The foregoing is a summary and thus by necessity contains simplifications, generalizations, and omissions of detail. Consequently, those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

BRIEF DESCRIPTION OF THE DRAWINGS

Further features, characteristics, and advantages of the present disclosure will become apparent to a person of ordinary skill in the art from the following detailed description of embodiments of the present disclosure, made with reference to the drawings annexed, in which like reference characters refer to like elements.

DETAILED DESCRIPTION

Referring to the FIGURES generally, a toilet assembly is shown according to various exemplary embodiments. The toilet assembly includes a vitreous bowl insert received in a bowl of a non-vitreous flush engine, and a rinse rim disposed on the flush engine. A vitreous pedestal shroud encloses the flush engine to provide a desired outer aesthetic. During use of the toilet assembly, the user may only see and feel the vitreous china outer surface and may not be able to distinguish the toilet assembly from a conventional toilet formed entirely from vitreous china. Furthermore, the flush engine may be a standardized (i.e., uniform) part, such that the same flush engine is configured to be enclosed in shrouds having various outer shapes to provide corresponding different aesthetics.

Figure 1:
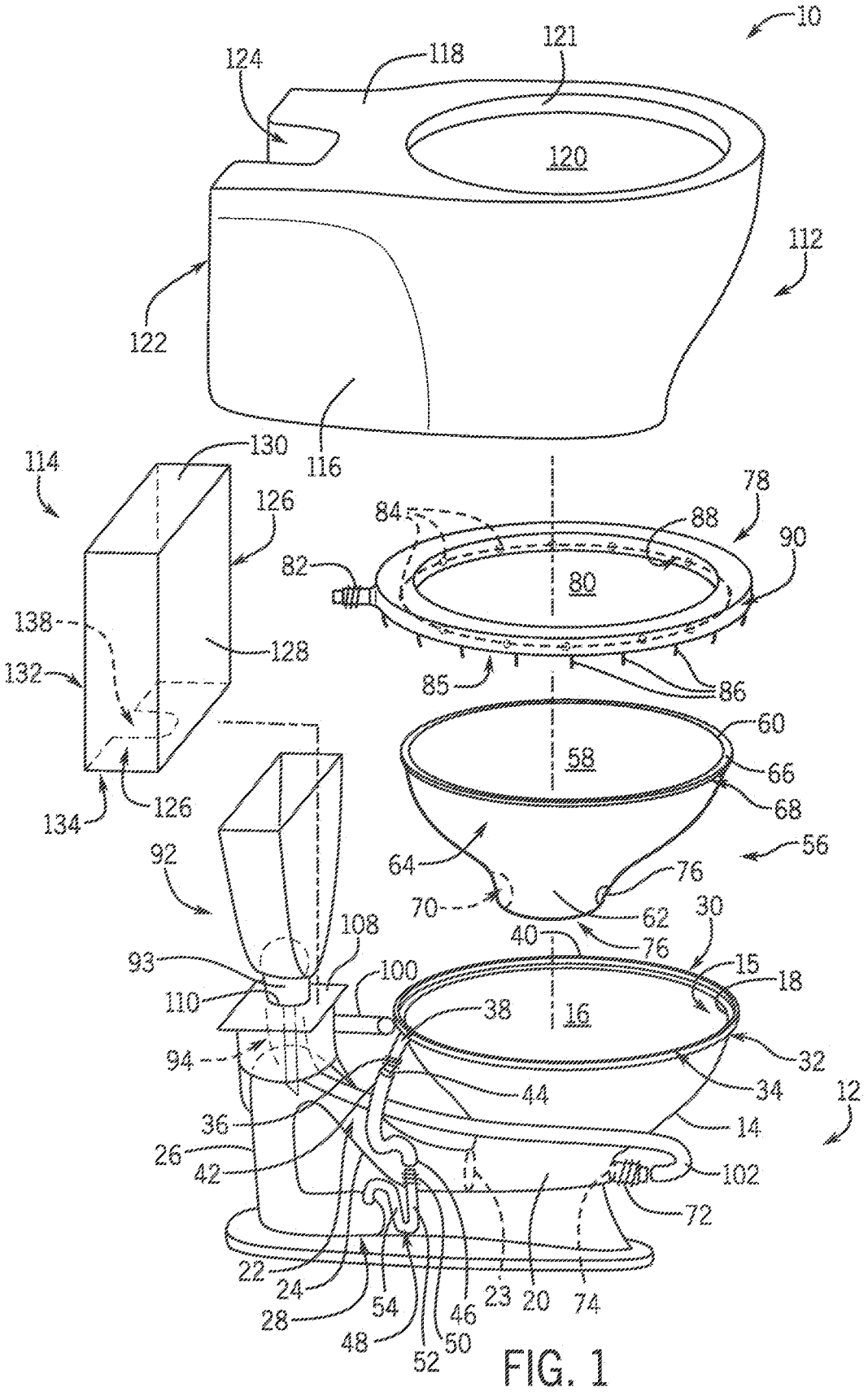
FIG. 1 is an exploded view of a toilet assembly, according to an exemplary embodiment.

Referring to FIG. 1, a toilet assembly 10 is shown with a non-vitreous (e.g., plastic) flush engine 12 according to an exemplary embodiment. The flush engine 12 includes a bowl 14 (i.e., bowl portion, bowl structure, bowl support, etc.), an opening 16 defined at an upper periphery 18 of the bowl 14, and a trapway 22. The bowl 14 further defines an inner surface 15 and a sump 20 (i.e., sump portion) at a lower portion thereof. The trapway 22 (i.e., primary trapway) extends from a trapway inlet 23 defined at a rear portion of the sump 20 and includes a weir having an up leg 24 extending at a vertically upward incline from the sump 20 and a down leg 26 extending vertically downward from a downstream end of the up leg 24. A drain opening 28 is defined at a downstream end of the down leg 26 and is configured to fluidly connect the trapway 22 to a drain in a building. In the configuration shown in FIG. 1, the trapway 22 is configured as a siphonic trapway. However, it should be understood that the trapway 22 may be configured as a wash-down trapway, without the weir and both the up leg 24 and the down leg 26. Furthermore, while FIG. 1 shows the flush engine 12 formed from a non-vitreous material, according to other exemplary embodiments, at least a portion of the flush engine 12 may be formed from a vitreous material.

Figure 3:
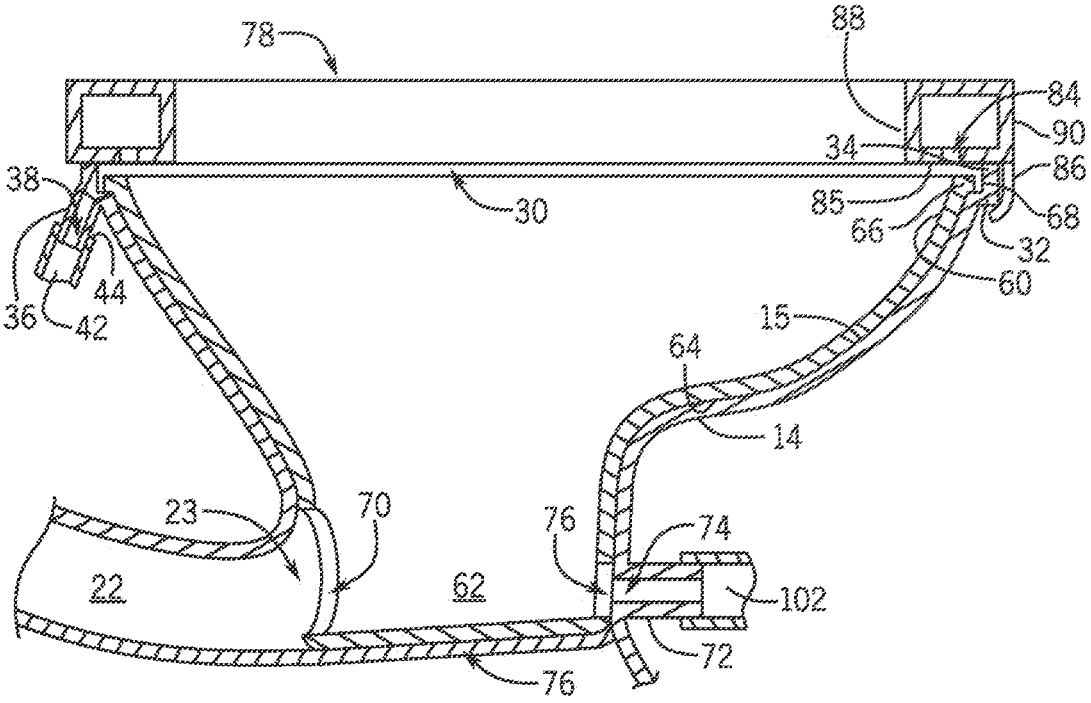
FIG. 3 shows the toilet assembly of FIG. 1 with a rinse rim installed on the flush engine.

The flush engine 12 further comprises an overflow rim 30 formed at and above the upper periphery 18 of the bowl 14. The overflow rim 30 defines a generally "L"-shaped cross section as shown in FIG. 3 and comprises a first portion 32 extending laterally outward from the upper periphery 18 and a second portion 34 extending vertically upward from the first portion 32 (above the upper periphery 18 of the bowl 14). The flush engine 12 comprises an overflow nozzle 36 that extends from the overflow rim 30 and defines an overflow nozzle inlet 38, which is formed in at least one of the first or second portions 32, 34 of the overflow rim 30. Specifically, the overflow nozzle inlet 38 is defined below an upper periphery 40 of the overflow rim 30 (where the upper periphery 40 is the topmost edge of the flush engine 12 along the top of the second portion 34 of the overflow rim 30 and is positioned vertically above the upper periphery 18 of the bowl 14, as shown in FIG. 1). The overflow nozzle 36 fluidly connects the overflow rim 30 and the trapway 22 (via an overflow waterway 42 and an overflow trapway 48, as described further herein) to allow water to bypass flowing through the bowl 14, such that when a water level in the bowl 14 is above the upper periphery 18 of the bowl 14, the excess water is output through the overflow nozzle 36, flowing from the overflow rim 30, through the overflow nozzle 36, and into the trapway 22. Accordingly, the overflow nozzle 36 and the overflow rim 30 prevent the water level from reaching or exceeding the upper periphery 40 of the overflow rim 30 and overflowing from the flush engine 12, over the top of the upper periphery 40 of the overflow rim 30.

It should be noted that while FIG. 1 shows the overflow rim 30 integrally formed with the rest of the bowl 14, according to other exemplary embodiments, the overflow rim 30 may be separately formed from the rest of the bowl 14. In this configuration, during assembly of the toilet assembly 10, the overflow rim 30 is coupled to and sealingly engages the upper periphery 18 of the bowl 14.

As shown in FIG. 1, the flush engine 12 further comprises the overflow waterway 42 and the overflow trapway 48. The overflow waterway 42 (i.e., hose, passage, line, conduit, etc.) that defines an inlet 44 configured to be fluidly coupled to the overflow nozzle 36 and an outlet 46 configured to be fluidly coupled to the overflow trapway 48 in order to fluidly connect the overflow nozzle 36 and an overflow trapway nozzle 50 of the overflow trapway 48 (via the overflow trapway 48). The overflow trapway 48 comprises the overflow trapway nozzle 50 (i.e., inlet nozzle) at an inlet end of the overflow trapway 48, a down leg 52 extending generally downward from the overflow trapway nozzle 50, and an up leg 54 extending generally upward from a downstream end of the down leg 52. The up leg 54 is fluidly connected to the trapway 22 proximate the drain opening 28. The overflow trapway 48 fluidly connects the overflow nozzle 36 (at an inlet end of the overflow trapway 48, via the overflow waterway 42) and the trapway 22 (at an outlet end of the overflow trapway 48).

In use, water generally overflows in the bowl 14 when there is an obstruction (i.e., blockage) in the trapway 22. Once the excess water reaches the upper periphery 18 of the bowl 18, the excess water flows into the overflow rim 30 and then into and through the overflow nozzle 36, the overflow waterway 42, the overflow trapway 48, and finally the trapway 22. By passing the water from the overflow rim 30 to a portion of the trapway 22 proximate the drain outlet 28, the overflowing excess water is most likely to bypass the obstruction (and the bowl 14) and prevent overflow from the entire flush engine 12. It should be noted that the overflow trapway 48 may be fluidly connected to the trapway 22 in other locations or may be separately output to an area outside the flush engine 12. The overflow trapway 48 forms a water seal (e.g., air lock) between the overflow nozzle 36 and the trapway 22 which prevents gas present in the sewer line from being released through the overflow nozzle inlet 38.

The overflow waterway 42 may be formed from plastic (e.g., polyethylene), rubber, or other non-vitreous flexible or rigid material, such that the overflow waterway 42 may be coupled to and fluidly connect the overflow nozzle 36 and the overflow trapway nozzle 50 by routing the overflow waterway 42 around various components of the flush engine 12 (such as the bowl 14 and the majority of the trapway 22). The inlet 44 of the overflow waterway 42 may be threadably coupled to the overflow nozzle 36 or may be coupled to the overflow nozzle 36 in other ways (e.g., with a quick-connect configuration). Similarly, the outlet 46 of the overflow waterway 42 may be threadably coupled to the overflow trapway nozzle 50 or may be coupled to the overflow trapway nozzle 50 in other ways. Integrally forming waterways as part of the molded components of the flush engine 12 during a molding process may be difficult and expensive and limit the possible arrangements of the toilet assembly 10. However, by fluidly connecting the overflow waterway 42 and the overflow trapway 48 with a separate waterway 42, the cost and complexity of manufacturing the flush engine 12 may be reduced.

Referring still to FIG. 1, the toilet assembly 10 further includes a vitreous bowl insert 56 (i.e., bowl) configured to be received and located in the bowl 14 of the flush engine 12. The bowl insert 56 is received within the bowl 14 of the flush engine 12 such that the bowl 14 does not directly hold any fluid. An opening 58 is defined at an upper periphery 60 of the bowl insert 56 and a sump 62 (i.e., sump portion) is defined at a lower portion of the bowl insert 56. A lower surface 64 of the bowl insert 56 may define a shape (i.e., profile) complementary to a shape of the inner surface 15 of the bowl 14, such that the bowl insert 56 nests in the bowl 14. In this configuration, the bowl insert 56 may engage and be supported by the inner surface 15 of the bowl 14 at substantially all points of the lower surface 64 (as shown in FIG. 2).

The bowl insert 56 comprises a lip 66 that extends laterally outward from the upper periphery 60 of the bowl insert 56. Referring now to FIG. 2, the bowl insert 56 is shown disposed in the bowl 14. The first and second portions 32, 34 of the overflow rim 30 define a seat configured to receive the lip 66. For example, the lip 66 is disposed on (e.g., engages, rests on, is supported by) the top surface of the first portion 32 of the overflow rim 30, which corresponds to the upper periphery 18 of the bowl 14. An outer periphery 68 of the lip 66 may engage the inner surface of the second portion 34 of the overflow rim 30, preventing lateral movement of the bowl insert 56 within the bowl 14 and the overflow rim 30. According to another exemplary embodiment, the outer periphery 68 may be spaced apart from the inner surface of the second portion 34, defining a channel therebetween about the outer perimeter of the lip 66 of the bowl insert 56 and the inner perimeter of the second portion 34 of the overflow rim 30. The channel may then provide an area for overflow excess water to flow to the overflow nozzle 36 between the outer periphery 68 of the lip 66 and the inner surface of the second portion 34 of the overflow rim 30. For example, the channel may define an incline, such that the overflow nozzle 36 is disposed at a lowest portion of the overflow rim 30, ensuring that all overflow water is output from the overflow rim 30 through the outlet nozzle 36. In a configuration in which the lower surface 64 of the bowl insert 56 does not form a complementary shape to the inner surface 15 of the bowl, the lip 66 may support the bowl insert 56, such that the bowl insert 56 is at least partially suspended in the bowl 14.

Figure 2:
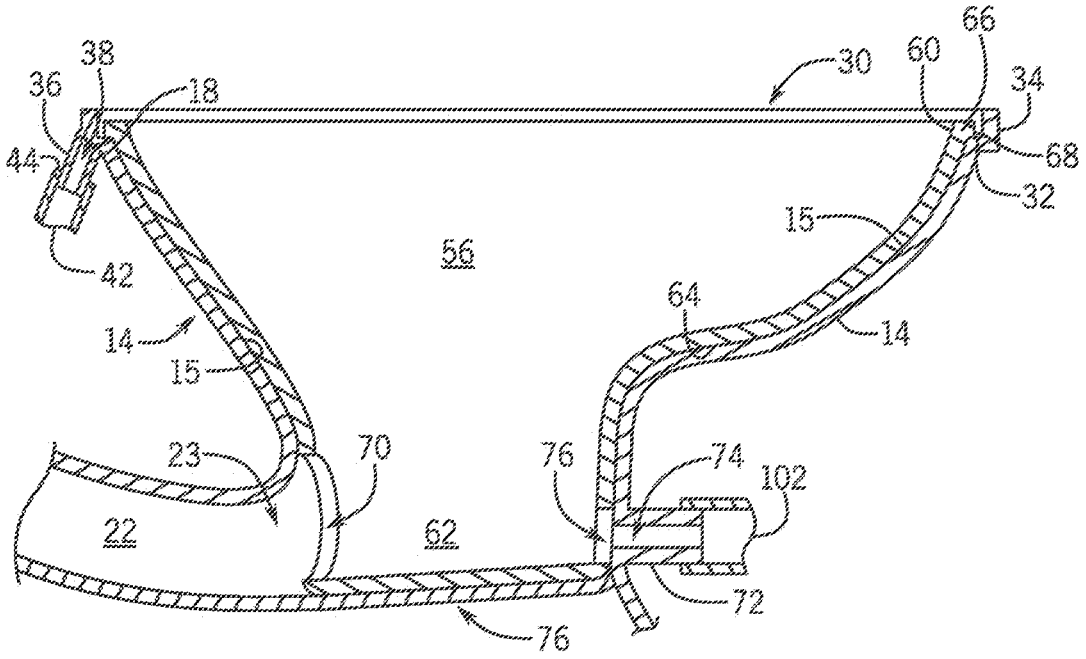
FIG. 2 shows the toilet assembly of FIG. 1 with a vitreous bowl insert received in a bowl of a non-vitreous flush engine.

As shown in FIG. 2, the bowl insert 56 further defines a trapway opening 70 in the sump 62 aligned with and proximate the trapway inlet 23 of the trapway 22 when the bowl insert 56 is received within the bowl 14, such that during a flush cycle, water and/or waste passes from within the bowl insert 56, through trapway opening 70 of the bowl insert 56, and into and through the trapway inlet 23 of the trapway 22 for discharge. For example, the trapway opening 70 may define a complementary profile to the trapway inlet 23 and may be disposed directly on the trapway inlet 23, such that water and/or waste does not pass between the bowl 14 and the bowl insert 56. According to other exemplary embodiments, a seal (e.g., gasket) may be disposed around the trapway opening 70 and trapway inlet 23, and compressed between the bowl 14 and the bowl insert 56, such that the bowl insert 56 sealingly engages the bowl 14 and water does not flow between the bowl insert 56 and the bowl 14, forming a sealed passage from the sump 62 to the trapway 22.

As shown in FIG. 2, the bowl insert 56 is disposed on and covers the inside surfaces of the bowl 14, such that the bowl insert 56 but not the bowl 14 is exposed to the environment (e.g., water and waste). In this configuration, substantially the entire surface that a user may interact with (and is visible to the user) is formed from vitreous china (of the bowl insert 56 (in an inner area of the toilet assembly 10) and the shrouds 112, 114 (in outer areas of the toilet assembly 10, as described further herein)), rather than non-vitreous material (e.g., plastic) forming the flush engine 12 (in particular the bowl 14), effectively providing the desired sanitary effects of vitreous china on the exposed surfaces.

Referring to FIGS. 1 and 2, the flush engine 12 includes a sump nozzle 72, defining a sump nozzle outlet 74 formed in the sump 20 of the bowl 14. The sump nozzle 72 extends generally outward from the sump 20 of the bowl 14. The bowl insert 56 defines a sump opening 76 in the sump 62 of the bowl insert 56. The sump opening 76 is aligned with and proximate the sump nozzle outlet 74 when the bowl insert 56 is received within the bowl 14, such that during a flush cycle, water passes from the sump nozzle 72, into and through the sump nozzle outlet 74 and subsequently the sump opening 76, into the sump 62 of the bowl insert 56. For example, the water may be supplied to the sump 62 of the bowl insert 56 for generating a siphon (e.g., in a siphon toilet) or as wash-down water (e.g., in a wash-down toilet). The sump opening 76 of the bowl insert 56 may define a complementary profile to the sump nozzle outlet 74 of the bowl 14 and may be disposed directly on the sump nozzle outlet 74, such that water does not pass between the bowl 14 and the bowl insert 56. According to other exemplary embodiments, a seal (e.g., gasket) may be disposed around the sump nozzle outlet 74 and the sump opening 76, and compressed between the bowl 14 and the bowl insert 56, such that the bowl insert 56 sealingly engages the bowl 14 and water does not flow between the bowl insert 56 and the bowl 14, forming a sealed passage from the sump nozzle 72 to the sump 62.

Referring again to FIG. 1, the toilet assembly 10 further includes a rinse rim 78 configured to provide water to the bowl insert 56 during a flushing cycle. The rinse rim 78 is generally annular, having a hollow body and defining an opening 80 complementary in shape to (and optionally equal in size to or smaller than) the opening 58 of the bowl insert 56. The rinse rim 78 may define a profile substantially similar to a profile of the lip 66 of the bowl insert 56, such that when the rinse rim 78 is installed in the toilet assembly 10, the rinse rim 78 vertically covers the lip 66 (as shown in FIG. 3). As shown in FIG. 1, a rinse nozzle 82 extends from a rear portion of the rinse rim 78 and is configured to receive water from a water supply and pass the water through the rinse rim 78. The rinse rim 78 further defines a plurality of rinse openings 84 formed in at least one of a lower surface 85 or an inner surface 88 of the rinse rim 78 and configured to supply the water from the rinse nozzle 82 and within the rinse rim 78 (i.e., through a channel formed by the hollow body of the rinse rim 78), into the bowl insert 56.

Referring now to FIGS. 1 and 3, the rinse rim 78 is configured to be coupled to a top portion of the flush engine (e.g., to the overflow rim 30 of the flush engine 12) with, for example, an interference fit. The rinse rim 78 includes a plurality of flexible fingers 86 extending generally downward from the lower surface 85 and/or an outer periphery (e.g., outer surface) 90 of the rinse rim 78. As shown in FIG. 3, the plurality of fingers 86 are configured to engage around the outer surface of the overflow rim 30 (e.g., along the outer surfaces of the first portion 32 and/or the second portion 34) with an interference fit, such that the rinse rim 78 may be coupled to (e.g., snapped on) the overflow rim 30 without the use of tools. This configuration reduces the cost and complexity of assembling the toilet assembly 10.

When the rinse rim 78 is installed on the overflow rim 30, the fingers 86 may extend below the first portion 32 of the overflow rim 30 and radially inward beneath the first portion 32 to form the interference fit. According to another exemplary embodiment, the second portion 34 of the overflow rim 30 may define a groove (i.e., channel, inset portion) configured to receive at least a portion of the fingers 86 extending radially inward. While FIG. 3 shows the fingers 86 extending from the rinse rim 78 and engaging the overflow rim 30, according to other exemplary embodiments, the fingers 86 may extend generally upward from the overflow rim 30 and engage the rinse rim 78 or the rinse rim 78 may be coupled to the overflow rim 30 or other parts of the flush engine 12 in other ways.

Figure 4:
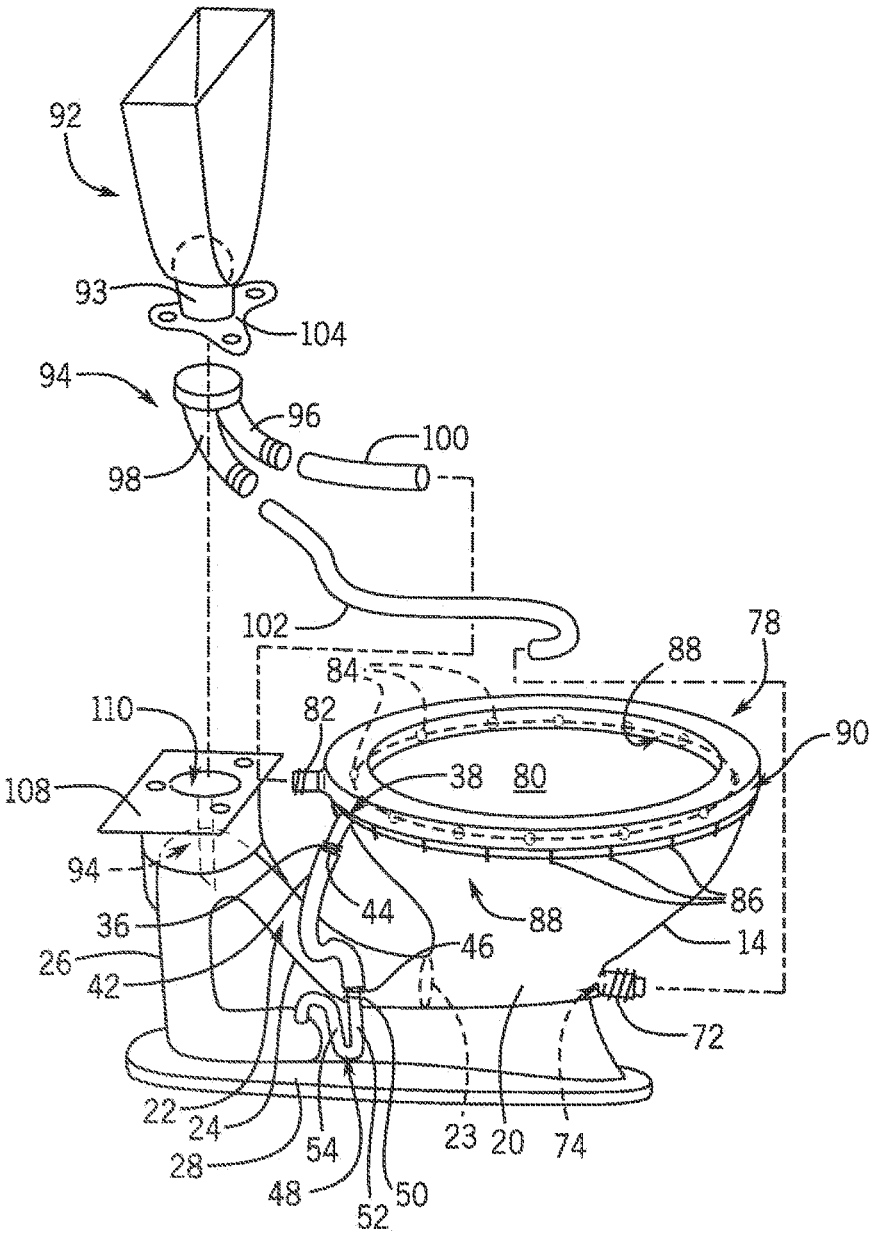
FIG. 4 is an exploded view of the toilet assembly, according to another exemplary embodiment.

Referring to FIGS. 1 and 4, the toilet assembly 10 further includes a tank 92 as a water supply configured to supply water to the rinse rim 78 and to the sump 62. The tank 92 is formed from a non-vitreous material (e.g., the same material as the rest of the flush engine 12) and is disposed above the trapway 22, such that water may be gravity-fed from the tank 92 to the rinse rim 78 and the sump 62. The tank 92 narrows proximate a lower end thereof, defining a neck 93 (e.g., conduit) narrower than the rest of the tank 92. A conduit 94 (i.e., splitter) extends downstream from the neck 93 and defines a rinse outlet 96 and a separate sump outlet 98. As shown in FIG. 4, a non-vitreous rinse waterway 100, substantially similar to the overflow waterway 42, fluidly couples the rinse outlet 96 and the rinse nozzle 82, such that water is supplied from the tank 92 to the rinse rim 78. Similarly, a non-vitreous sump waterway 102, substantially similar to the overflow waterway 42 and the rinse waterway 100, fluidly couples the sump outlet 98 and the sump nozzle 72, such that water is supplied from the tank 92 to the sump 62. In this configuration, water may be supplied to both the rinse waterway 100 and the sump waterway 102 from the tank 92 as part of the same actuation sequence. According to an exemplary embodiment, the tank 92 may be separately formed from and coupled to the flush engine 12, although according to other exemplary embodiments, the tank 92 is molded as part of the flush engine 12 (e.g., integrally formed). However, the toilet assembly 10 may be modified and configured to accommodate different ways of flushing the toilet. For example, according to another embodiment, the toilet assembly 10 may be tankless (rather than using a gravity flush) and instead utilize line pressure from the wall.

Referring now to FIG. 4, the tank 92 is shown as a separate subassembly. The tank 92 includes a flange 104 that extends laterally outward from the neck 93 and is configured to couple the rest of the tank 92 to at least one of the flush engine 12 or a shroud, as will be discussed in further detail below. For example, FIG. 4 shows a platform 108 disposed above the trapway 22 (e.g., where the trapway 22 transitions from the up leg 24 to the down leg 26). The flange 104 may be coupled (e.g., bolted, screwed, adhered, etc.) to the platform 108. The platform 108 defines an opening 110 therein configured to receive at least one of the neck 93 or a portion of the conduit 94, which may be separately formed from the tank 92 and fluidly coupled to the neck 93. While FIGS. 1-4 show the tank as a water supply, it should be understood that according to other exemplary embodiments, water may be supplied directly from a building water supply line.

Figure 5:
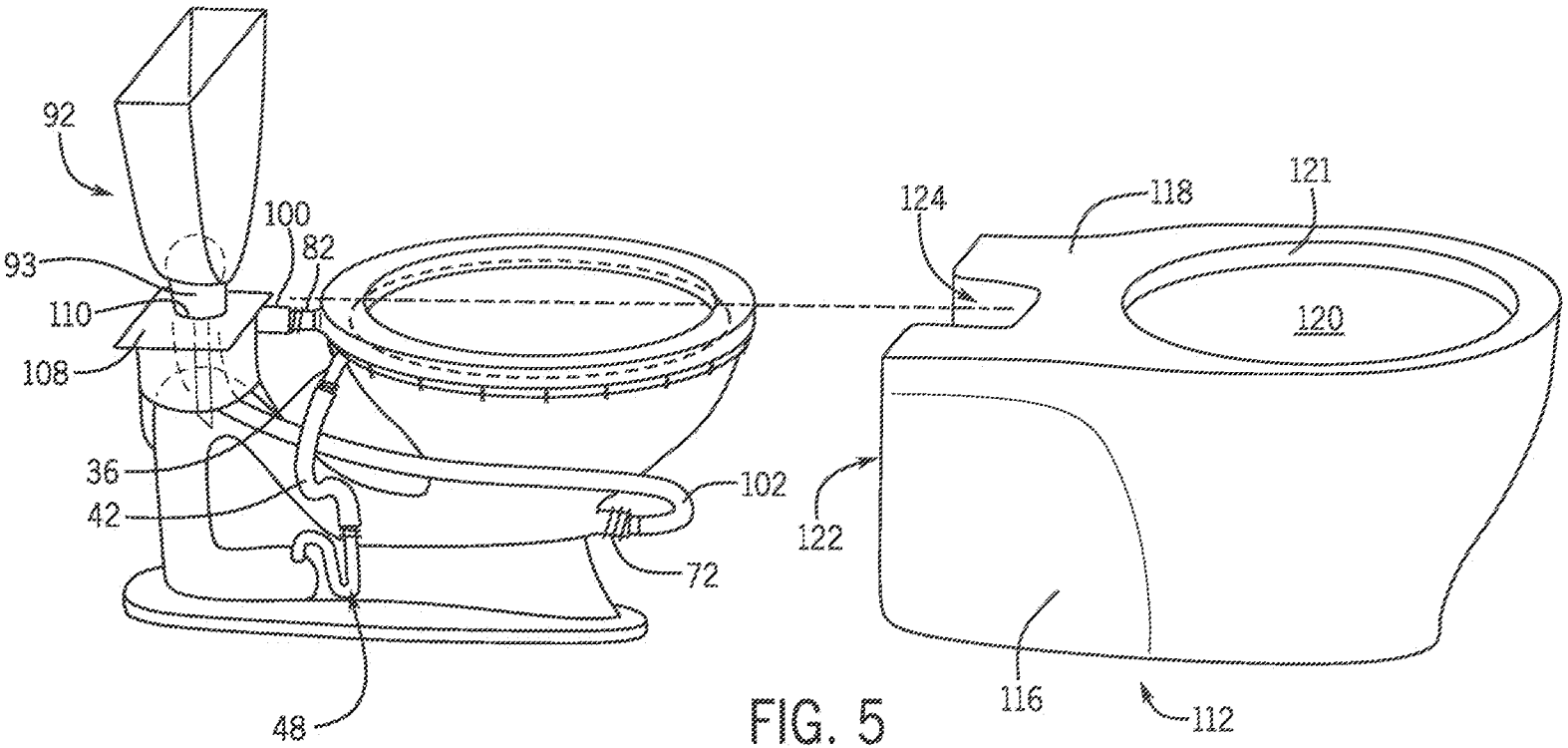
FIG. 5 shows the toilet assembly of FIG. 1 with a pedestal shroud in an installed position.

As shown in FIG. 1, the toilet assembly 10 further comprises a pedestal shroud 112 and a tank shroud 114 that are configured to be installed onto and positioned over at least a portion of the flush engine 12 to conceal at least the portion of the flush engine 12. Due to the configuration of the toilet assembly 10, the pedestal shroud 112 and the tank shroud 114 are fluidly separate from directly contacting any liquid within the toilet assembly 10. The pedestal shroud 112 includes side surfaces 116 having a desired aesthetic appearance and an upper surface 118 defining an opening 120 therein. The pedestal shroud 112 further includes a shoulder 121 that extends generally downward from the upper surface 118 at a periphery of the opening 120. The opening 120 defines a profile complementary to the opening 16 of the bowl 14 and/or the opening 58 of the bowl insert 56. The pedestal shroud 112 is generally hollow and does not include a back, such that the pedestal shroud 112 may be installed by sliding the pedestal shroud 112 generally rearward along and over the flush engine 12, as shown in FIG. 5. In other words, an open rear end 122 of the pedestal shroud 112 is moved from the bowl 14 toward the tank 92 during installation until the flush engine 12 is positioned and received within the pedestal shroud 112. According to another exemplary embodiment, the pedestal shroud 112 may include a back. In this configuration, the flush engine 12 may be received in the pedestal shroud 112 through a corresponding opening in a bottom surface of the pedestal shroud 112 or may be received in the pedestal shroud 112 during the casting process of the pedestal shroud 112. In this or other configurations, the flush engine 12 may be inserted into the pedestal shroud 112 before the toilet assembly 10 is installed on a floor or against a wall in a bathroom.

As shown in FIGS. 1 and 5, the upper surface 118 defines a slot 124 extending from the rear end 122 toward the opening 120. The slot 124 is configured to receive the neck 93 of the tank 92 therein, such that the tank 92 may be integrally formed with the flush engine 12 and/or may be coupled to the flush engine 92 before the pedestal shroud 112 is installed.

Where the tank 92 is separate from the flush engine 12 (e.g., as shown in FIG. 4), the tank 92 may be coupled to the pedestal shroud 112 by coupling the flange 104 to the upper surface 118 of the pedestal shroud 112 proximate the slot 124. At least one of the neck 93 or the conduit 94 extends through the slot 124. According to another exemplary embodiment, where the tank 92 is separate from the flush engine 12, the slot 124 may be formed as an opening (i.e., hole, orifice, etc.) spaced apart from the rear end 122 of the pedestal shroud 112. In this configuration, the neck 93 and/or the conduit 94 is passed through the slot 124 after the pedestal shroud 112 is installed on the flush engine 12. While FIG. 5 shows the pedestal shroud 112 with an open rear end 122, according to an exemplary embodiment, a cover may be installed on the pedestal shroud 112 after the pedestal shroud 112 is installed on the flush engine 12, thereby enclosing the flush engine 12 along all sides with the pedestal shroud 112 and the cover.

Figure 6:
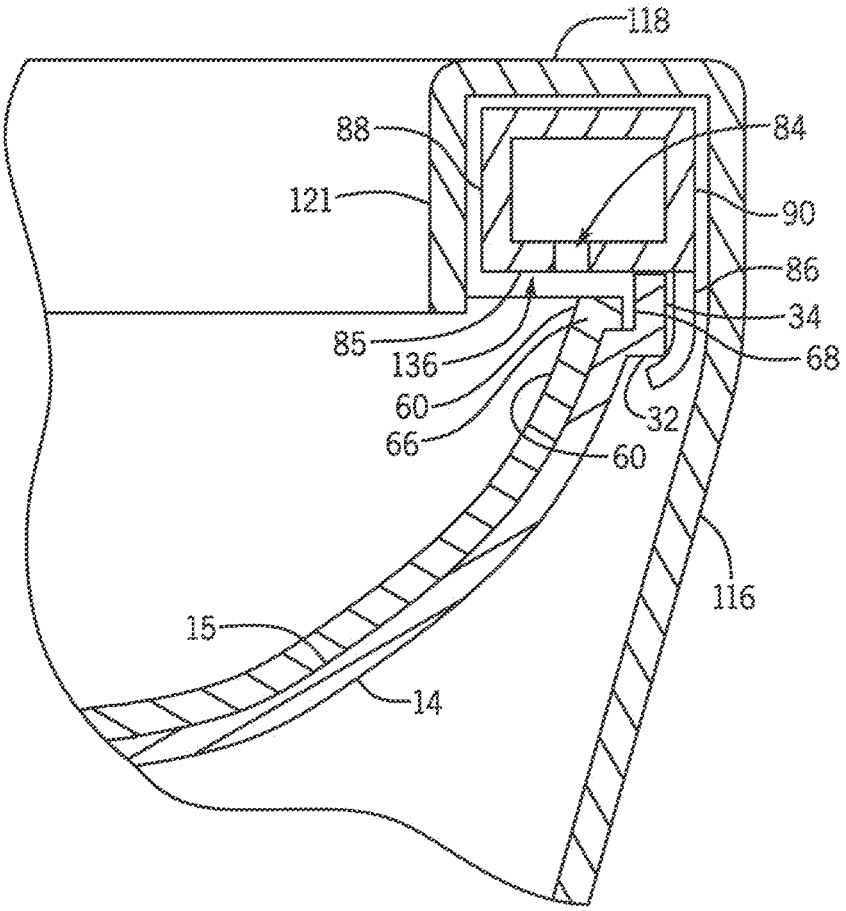
FIG. 6 is a partial cross-sectional of the toilet assembly of FIG. 5.

Referring now to FIG. 6, a cross-section of a portion of the toilet assembly 10 of FIG. 5 is shown, according to an exemplary embodiment. As shown in FIG. 6, the shoulder 121 of the pedestal shroud 112 extends below the lower surface 85 of the rinse rim 78, such that the rinse rim 78 is completely concealed within the pedestal shroud 112 from view when the pedestal shroud 112 is installed. The rinse rim 78 is disposed laterally between the shoulder 121 and the side surface 116 of the pedestal shroud 112. For example, the inner surface 88 of the rinse rim 78 may be disposed on or proximate the shoulder 121 regardless of the position of the side surface 116. The rinse openings 84 are formed in the rinse rim 78 radially inward from the lip 66 of the bowl insert 56, such that when water is introduced through the rinse openings 84, the water passes vertically downward along the bowl insert 56 rather than along the lip 66 and into the overflow rim 30. In this configuration, the rinse rim 78 does not need to sealingly engage the overflow rim 30, because even if the water level in the bowl insert 56 rises, the presence of the overflow nozzle 36 (as shown in FIG. 2) prevents the water level from reaching the connection point (e.g., seam) between the overflow rim 30 and the rinse rim 78, which may otherwise need to be sealed to prevent leakage therebetween in the event of an overflow.

As shown in FIG. 6, when the rinse rim 78 is installed on the overflow rim 30, a vertical gap 136 (i.e., space, offset, etc.) is defined between the top surface of the lip 66 and the lower surface 85 of the rinse rim 78. This gap 136 allows for water to pass over the lip 66 (between the top surface of the lip 66 and the lower surface 85 of the rinse rim 78) and into the overflow rim 30 during an overflow condition. A height of the second portion 34 of the overflow rim 30 (that is above the top surface of the lip 66) may define the height of the gap 136. FIG. 6 further shows the finger 86 engaging the overflow rim 30 with an interference fit.

Figure 7:
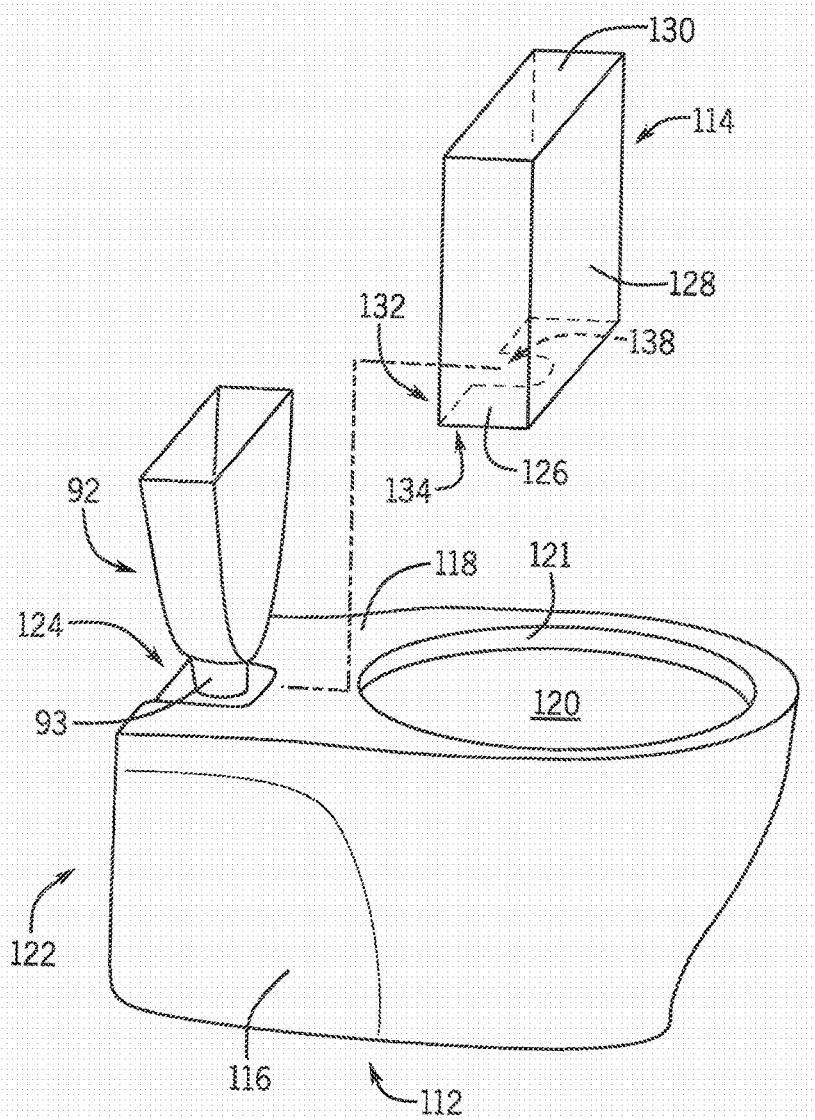
FIG. 7 shows the toilet assembly of FIG. 5 with a tank shroud in an installed position.

Referring now to FIGS. 1 and 7, the tank shroud 114 is shown being installed on the flush engine 12. The tank shroud 114 includes side surfaces 126, a front surface 128, and an upper surface 130 having a desired aesthetic appearance. The tank shroud 114 is generally hollow and does not include a back, such that the tank shroud 114 may be installed by sliding the tank shroud 114 generally rearward along the flush engine 12. In other words, an open rear end 132 of the tank shroud 114 is moved from over the bowl 14 toward the tank 92 until the tank 92 is positioned and received within the tank shroud 114. According to other exemplary embodiments, the tank shroud 114 includes a back and the tank 92 is received in the tank shroud 114 in other ways. For example, the tank shroud 114 may define an opening in a lower surface 134 configured to receive the tank 92 therethrough, such that the tank shroud 114 may be lowered onto and over the tank 92. According to another exemplary embodiment, where the tank 92 is separable from the rest of the flush engine 12, the tank 92 may be lowered into the tank shroud 114. In this configuration, the tank 92 may be coupled to the flush engine 12 either before or after being inserted into the tank shroud 114.

Referring still to FIGS. 1 and 7, the lower surface 134 defines a slot 138 extending from the rear end 132 toward the front surface 128. The slot 138 may be substantially the same as the slot 124 in the pedestal shroud 112 and is configured to receive the neck 93 of the tank 92 therein. The tank shroud 114 is installed on the pedestal shroud 112 by resting the lower surface 134 of the tank shroud 114 on the upper surface 118 of the pedestal shroud 112. In this configuration, the tank shroud 114 may be coupled to the pedestal shroud 112. According to other exemplary embodiments, the tank shroud 114 may be spaced apart from the pedestal shroud 112 based on a desired aesthetic appearance.

As discussed above, the pedestal and tank shrouds 112, 114 are formed from a material that is vitreous china and provide a sanitary outer surface of the toilet assembly 10. Further, the bowl insert 56 is also formed from a material that is vitreous china. When the toilet assembly 10 is fully assembled, the bowl insert 56 conceals the inner surface 15 of the bowl 14 from view and the pedestal shroud 112 and/or the tank shroud 114 conceals the rest of the flush engine 12 from view. In this configuration, while the flush engine 12 (in particular the bowl 14 and trapway 22) is formed from a material that is not vitreous china (i.e., a non-vitreous material), the entire flush engine 12 is concealed such that a user may only see and feel a vitreous china outer surface. It is noted that the flush engine 12, the bowl insert 56, the shrouds 112, 114, the tank 92, and the rinse rim 78 may each be separately formed from each other.

FIGS. 1, 5, and 7 show one aesthetic configuration of the pedestal shroud 112 and the tank shroud 114. However, it should be noted that the same flush engine 12 may be used with and configured to be at least partially received within various pedestal shrouds 112 and/or tank shrouds 114 having different external aesthetic appearances. For example, in an assembly line, first and second pedestal shrouds 112 having different outer shapes may be provided. A flush engine 12 is also provided, which is configured to be received in either of the first and second pedestal shrouds 112. Similarly, first and second tank shrouds 114 having different outer shapes may be provided. The tank 92 may be standardized in the same way as the flush engine 12, such that the tank 92 is configured to be received in either of the first and second tank shrouds 114. According to another exemplary embodiment, the first pedestal shroud 112 and/or the first tank shroud 114 may be removed from the flush engine 12 and replaced with the second pedestal shroud 112 and/or the second tank shroud 114. As a result of this replacement, the flush engine 12 may remain installed in a bathroom, while the shrouds are changed to provide a different aesthetic appearance. Advantageously, the interchangeability of the shrouds allows for easily changing the appearance of the toilet assembly 10, while minimizing or eliminating the need to further plumb the toilet assembly 10.

The toilet assembly 10 can be used within commercial toilets (e.g., for use in airports, restaurants, or other high-traffic areas) or for in-home, non-commercial use. The toilet can be configured as a gravity fed (e.g., that includes a toilet tank that introduces water into the bowl through gravity) or may be configured as a line pressure toilet that does not include a tank but utilizes water flowing in from a water line directly to the bowl and rim areas. Additionally, the toilet assembly 10 may include a flushometer in order to meter the fluid flow to the bowl and/or rim.

Figure 8:
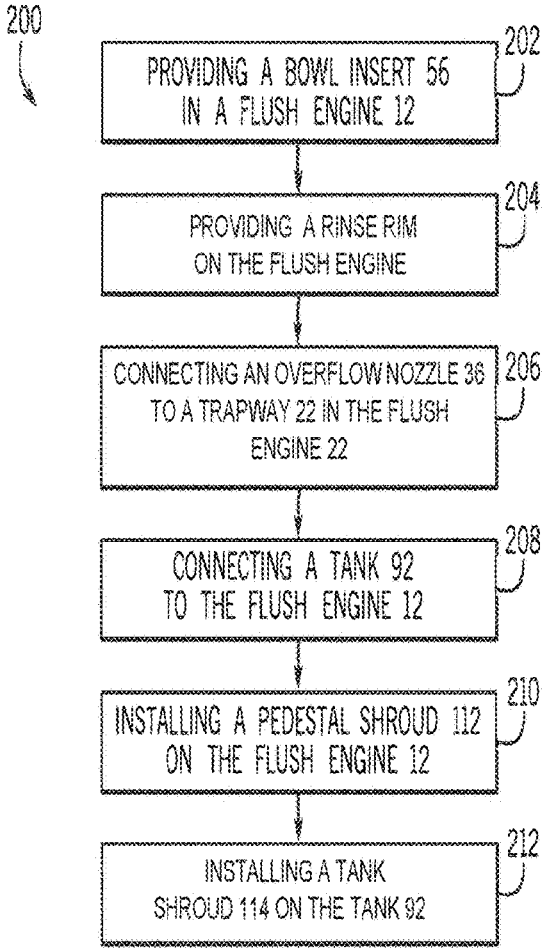
FIG. 8 is a block diagram of method of assembling a toilet assembly enclosing a standardized flush engine in a shroud.

Referring now to FIG. 8, a method 200 of manufacturing a toilet assembly 10 is shown according to an exemplary embodiment. In a first step 202, a bowl insert is provided in a bowl of a universal flush engine. For example, with reference to the accompanying figures, a bowl insert such as bowl insert 56 is provided in or inserted into the bowl 14 of the flush engine 12. This may be a manual process or may utilize an assembly robot. According to other embodiments, the flush engine 12 may be inverted and provided onto the bowl insert 56, which is also inverted. When the bowl insert 56 is provided in the bowl 14, the trapway opening 70 of the bowl insert 56 is substantially aligned with the trapway inlet 23 and/or the sump opening 76 is substantially aligned with the sump nozzle 72.

In a second step 204, a rinse rim is provided on an overflow rim of the flush engine. For example, with reference to the accompanying figures, a rinse rim such as rinse rim 78 is provided on or coupled to the overflow rim 30 of the flush engine 12. This may be a manual process or may utilize an assembly robot. According to other embodiments, the flush engine 12 and the bowl insert 56 may be inverted and provided onto the rinse rim 78, which is also inverted. As the rinse rim 78 is moved closer to the overflow rim 30, the plurality of fingers 86 engage the second portion 34 of the overflow rim 30, which forces at least a portion of the plurality of fingers 86 to expand laterally outward. After the lower surface 85 of the rinse rim 78 is disposed on the overflow rim 30, the plurality of fingers 86 rebound to an non-deflected condition, such that at least a portion of the below the first portion 32 of the overflow rim 30, coupling the rinse rim 78 to the overflow rim 30 with an interference fit. According to other exemplary embodiments, the rinse rim 78 may be coupled to the overflow rim 30 with single finger 86 or other structure providing an interference fit or may be coupled to the overflow rim 30 in other ways (e.g., with a fastener, adhesive, etc.).

In a third step 206, an overflow nozzle in the overflow rim is fluidly connected to a trapway. For example, with reference to the accompanying figures, an overflow nozzle such as overflow nozzle 36 extends from the overflow rim 30. An overflow waterway 42 is coupled to the overflow nozzle 36 and to the trapway 22. During operation of the toilet assembly 10 during a flush cycle, if the trapway 22 is clogged, causing water to rise above the first portion 32 of the overflow rim 30 (and above the top surface of the lip 66 of the bowl insert 56), water passes in a channel formed between the lip 66 of the bowl insert 56 and the second portion 34 of the overflow rim 30. The water then passes from this channel, through the overflow nozzle 36 and the overflow waterway 42 before being fed to the trapway 22 or the intervening overflow trapway 48.

According to an exemplary embodiment, the overflow waterway 42 is fluidly coupled to an overflow trapway 48, which is connected to the trapway 22. The overflow trapway 48 forms a water lock configured to prevent gases in the trapway 22 from exiting the trapway 22 through the overflow trapway 48. The overflow waterway 42 may be press-fit onto the overflow nozzle 36 and/or the overflow trapway 48, or may be coupled to the overflow nozzle 36 and/or the overflow trapway 48 in other ways (e.g., threadably coupled, glued, etc.).

In a fourth step 208, a tank is fluidly coupled to the flush engine. For example, with reference to the accompanying figures, a tank such as tank 92 is provided on and coupled to the flush engine 12 at a platform 108 disposed on the trapway 22. The tank 92 is provided with a conduit 94 defining a rinse outlet 96 and a separate sump outlet 98 for separately outputting water from the tank 92. The rinse outlet 96 is fluidly coupled to the rinse rim 78 at the rinse nozzle 82. Specifically, the rinse waterway 100, which may be formed from a flexible or rigid material that is not vitreous china, is coupled to and extends between the rinse outlet 96 and the rinse rim 78 (in particular the rinse nozzle 82 for supplying water from the tank 92 to the rinse rim 78). The rinse waterway 100 may be press-fit onto the rinse outlet 96 and/or the rinse nozzle 82, or may be coupled to the rinse outlet 96 and/or the rinse nozzle 82 in other ways (e.g., threadably coupled, glued, etc.). Similarly, the sump outlet 98 is fluidly coupled to the sump 62 at the sump nozzle 72. Specifically, the sump waterway 102, which may be formed from a flexible or rigid material that is not vitreous china, is coupled to and extends between the sump outlet 98 and the sump 62 (in particular the sump nozzle 72 for supplying water from the tank 92 to the sump 62). The sump waterway 102 may be press-fit onto the sump outlet 98 and/or the sump nozzle 72, or may be coupled to the sump outlet 98 and/or the sump nozzle 72 in other ways (e.g., threadably coupled, glued, etc.).

While the figures show the fourth step 208 including coupling the tank 92 to the flush engine 12, it should be understood that the according to other exemplary embodiments, the flush engine 12 may be supplied with water from a water supply line (not shown) instead of or in addition to the tank 92. For example, a water supply line may be provided in a wall in a bathroom. The water supply line provides pressurized water to the conduit 94, which then separates the water into streams in each of the rinse outlet 96 and the sump outlet 98 for outputting to the rinse rim 78 and the sump 62, respectively. According to another exemplary embodiment, the water supply line may include two separate water supply lines (e.g., first and second water supply lines). In this configuration, the rinse waterway 100 and the sump waterway 102 may be coupled to the water supply lines without an intervening conduit 94. For example, the rinse waterway 100 may be coupled to the first water supply line and the sump waterway 102 may be separately coupled to the second water supply line.

In a fifth step 210, a pedestal shroud is installed on a flush engine 12. For example, with reference to the accompanying figures, a pedestal shroud such as pedestal shroud 112 is disposed about and positioned over the flush engine 12. The pedestal shroud 112 is lifted above the ground, such that the shoulder 121 is positioned above and further away from the ground than the rinse rim 78. In this configuration, the fifth step 210 includes receiving the flush engine 12, including the bowl 14 and the rinse rim 78, through the rear end 122 of the pedestal shroud 112 and sliding the pedestal shroud 112 rearward relative to the flush engine 12. According to another exemplary embodiment, the pedestal shroud 112 is lifted above the ground, such that a bottom surface of the pedestal shroud 112 is positioned above and further away from the ground than the rinse rim 78. In this configuration, the fifth step 210 includes receiving the flush engine 12, including the bowl 14 and the rinse rim 78, through the bottom surface of the pedestal shroud 112. In either configuration, when the opening 120 in the pedestal shroud 112 is substantially vertically aligned with the opening 80 in the rinse rim 78, the pedestal shroud 112 is lowered onto the flush engine 12, such that the shoulder 121 is disposed laterally inward from and proximate the inner surface 88 of the rinse rim 78, thereby concealing the rinse rim 78 from view by a user.

In a sixth step 212, a tank shroud is installed about a tank and on a pedestal shroud. For example, with reference to the accompanying figures, a tank shroud such as tank shroud 114 is disposed about and positioned over the tank 92. The tank shroud 114 is lifted above the ground, such that the lower surface 134 of the tank shroud 114 is positioned above and further away from the ground than the platform 108 and/or the upper surface 118 of the pedestal shroud 112. In this configuration, the sixth step 212 includes receiving the tank 92 through the rear end 132 of the tank shroud 114 and sliding the tank shroud 114 rearward relative to the tank 92. According to another exemplary embodiment, the tank shroud 114 is lifted above the ground, such that the lower surface 134 of the tank shroud 114 is positioned above and further away from the ground than the tank 92. In this configuration, the sixth step 212 includes receiving the tank 92 through the lower surface 134 of the tank shroud 114. When the tank shroud 114 is installed and the tank 92 is received therein, the tank 92 is concealed from view during use of the toilet assembly 10, regardless of whether the tank 92 is inserted through an opening in either the rear end 132 or the lower surface 134 of the tank shroud 114. As shown in the figures, the tank shroud 114 may be coupled to the tank 92 and/or the pedestal shroud 112. For example, the lower surface 134 of the tank shroud 114 may be disposed on and engage the upper surface 118 of the pedestal shroud 112.

While the method 200 shows a process for assembling a toilet assembly 10, it should be understood that one or more of the steps in the method 200 may be performed in reverse in order to disassemble the toilet assembly 10. For example, such process may be used in order to replace the pedestal shroud 112 and/or the tank shroud 114. During a bathroom renovation, it may be desirable to replace toilets to provide a new desired aesthetic appearance. Rather than completely replacing the entire toilet, which will result in higher incurred costs, the pedestal shroud 112 (i.e., first pedestal shroud) and/or the tank shroud 114 (i.e., first tank shroud) may be replaced with a new pedestal shroud 112 (i.e., second pedestal shroud) and/or a new tank shroud 114 (i.e., second tank shroud) having different aesthetic appearances.

Figure 9:
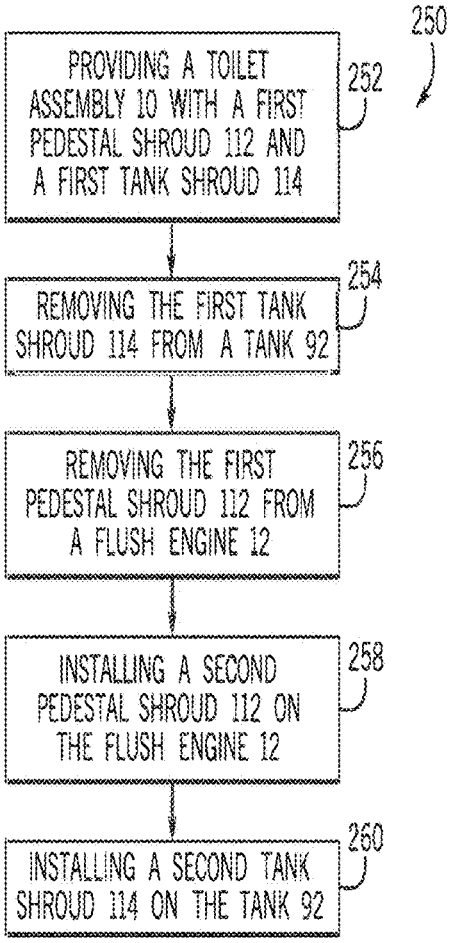
FIG. 9 is a block diagram of method of assembling a toilet assembly, replacing a first tank and pedestal shroud with a second tank and pedestal shroud having a different aesthetic appearance.

Referring now to FIG. 9, a method 250 of assembling (i.e., modifying, renovating, replacing, retrofitting, etc.) a toilet assembly 10 is shown according to an exemplary embodiment. In a first step 252, a toilet assembly is provided. For example, with reference to the accompanying figures, a toilet assembly may be the toilet assembly 10 including a universal flush engine 12, a tank 92, a first pedestal shroud 112 and a first tank shroud 114.

In a second step 254, a first tank shroud is removed (e.g., separated) from the tank. For example, with reference to the accompanying figures, a first tank shroud such as tank shroud 114 is originally disposed about the tank 92. The second step 254 includes separating or removing the first tank shroud 114 from the tank 92 and the pedestal shroud 112. For example, the second step 254 includes sliding the first tank shroud 114 forward relative to the tank 92 and passing the tank 92 through the rear end 132 of the first tank shroud 114. The first tank shroud 114 is then separated from the tank 92 for removal from the toilet assembly 10. According to another exemplary embodiment, the first tank shroud 114 is lifted upward away from the ground and separated from the tank 92. According to other exemplary embodiments, the first tank shroud 114 may be removed from the toilet assembly 10 in other ways.

In a third step 256, a first pedestal shroud is removed (e.g., separated) from the flush engine. For example, with reference to the accompanying figures, a first pedestal shroud such as pedestal shroud 112 is originally disposed about the flush engine 12. The third step 256 includes sliding the first pedestal shroud 112 forward relative to the flush engine 12 and passing the flush engine 12 through the rear end 122 of the pedestal shroud 112. The first pedestal shroud 112 is then separated from the flush engine 12 for removal from the toilet assembly 10. According to another exemplary embodiment, the first pedestal shroud 112 is lifted upward away from the ground and separated from the flush engine 12.

In a fourth step 258, a second pedestal shroud is installed on and positioned over the flush engine. For example, with reference to the accompanying figures, a second pedestal shroud such as pedestal shroud 112 is disposed about the flush engine 12. The second pedestal shroud 112 provides a different aesthetic appearance than the first pedestal shroud 112 and is configured to be coupled to the flush engine 12 in substantially the same way as the first pedestal shroud 112. The second pedestal shroud 112 is lifted above the ground, such that the shoulder 121 is positioned above and further away from the ground than the rinse rim 78. In this configuration, the fourth step 258 includes receiving the flush engine 12, including the bowl 14 and the rinse rim 78, through the rear end 122 of the second pedestal shroud 112 and sliding the second pedestal shroud 112 rearward relative to the flush engine 12. According to another exemplary embodiment, the second pedestal shroud 112 is lifted above the ground, such that a bottom surface of the second pedestal shroud 112 is positioned above and further away from the ground than the rinse rim 78. In this configuration, the fourth step 258 includes receiving the flush engine 12, including the bowl 14 and the rinse rim 78, through the bottom surface of the second pedestal shroud 112. In either configuration, when the opening 120 in the second pedestal shroud 112 is substantially vertically aligned with the opening 80 in the rinse rim 78, the second pedestal shroud 112 is lowered onto the flush engine 12, such that the shoulder 121 is disposed laterally inward from and proximate the inner surface 88 of the rinse rim 78, thereby concealing the rinse rim 78 from view by a user.

In a fifth step 260, a second tank shroud is installed about a tank and on a second pedestal shroud. For example, with reference to the accompanying figures, a second tank shroud such as tank shroud 114 is disposed about the tank 92. The second tank shroud 114 provides a different aesthetic appearance than the first tank shroud 114 and is configured to be coupled to the tank 92 and/or the second pedestal shroud 112 in substantially the same way as the first tank shroud 114. For example, the second tank shroud 114 is lifted above the ground, such that the lower surface 134 of the second tank shroud 114 is positioned above and further away from the ground than the platform 108 and/or the upper surface 118 of the second pedestal shroud 112. In this configuration, the fifth step 260 includes receiving the tank 92 through the rear end 132 of the second tank shroud 114 and sliding the second tank shroud 114 rearward relative to the tank 92. According to another exemplary embodiment, the second tank shroud 114 is lifted above the ground, such that the lower surface 134 of the second tank shroud 114 is positioned above and further away from the ground than the tank 92. In this configuration, the fifth step 260 includes receiving the tank 92 through the lower surface 134 of the second tank shroud 114. When the second tank shroud 114 is installed and the tank 92 is received therein, the tank 92 is concealed from view during use of the toilet assembly 10, regardless of whether the tank 92 is inserted through an opening in either the rear end 132 or the lower surface 134 of the tank shroud 114. As shown in the figures, the second tank shroud 114 may be coupled to the tank 92 and/or the second pedestal shroud 112. For example, the lower surface 134 of the second tank shroud 114 may be disposed on and engage the upper surface 118 of the second pedestal shroud 112.

It should be understood that while the method 250 shown in FIG. 9 includes replacing both the first tank shroud 114 and the first pedestal shroud 112, according to other exemplary embodiments, only one of the first tank shroud 114 or the first pedestal shroud 112 may be replaced to change the aesthetics. For example, after the second pedestal shroud 112 is installed on the flush engine 12, the first tank shroud 114 may be installed about the tank 92 on the second pedestal shroud 112, such that the aesthetic appearance of the tank shroud 114 remains the same but the aesthetic appearance of the pedestal shroud 112 changes. Similarly, the third and fourth steps 256, 258 directed to removing and replacing the pedestal shroud 112 may be skipped, such that the first pedestal shroud 112 remains installed and only the first tank shroud 114 is replaced with the second tank shroud 114. In this configuration, the appearance of the pedestal shroud 112 remains the same but the aesthetic appearance of the tank shroud 114 changes. According to yet another exemplary embodiment, the first pedestal shroud 112 may be replaced with the second pedestal shroud 112 without first removing the tank shroud 114 or the toilet assembly 10 may not include a tank 92 or a tank shroud 114, such that only the pedestal shroud 112 is replaced. According to yet another exemplary embodiment, the tank shroud 114 may be integrally formed with the pedestal shroud 112, such that the second and third steps 254, 256 are performed at the same time as each other and the fourth and fifth steps 258, 260 are performed at the same time as each other.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of this disclosure as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the position of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is to be understood that although the present invention has been described with regard to preferred embodiments thereof, various other embodiments and variants may occur to those skilled in the art, which are within the scope and spirit of the invention, and such other embodiments and variants are intended to be covered by corresponding claims. Those skilled in the art will readily appreciate that many modifications are possible (e.g., variations in sizes, dimensions, structures, shapes and proportions of the various elements, values of parameters, mounting arrangements, use of materials, colors, orientations, manufacturing processes, etc.) without materially departing from the novel teachings and advantages of the subject matter described herein. For example, the order or sequence of any process or method steps may be varied or re-sequenced according to alternative embodiments. Other substitutions, modifications, changes and omissions may also be made in the design, operating conditions and arrangement of the various exemplary embodiments without departing from the scope of the present disclosure.

The invention claimed is:

1. An apparatus comprising:

a bowl, formed from a non-vitreous material, comprising an opening at a bowl upper periphery and a sump at a lower portion of the bowl, wherein the bowl does not directly hold any fluid;

an overflow rim, formed from a non-vitreous material, at the bowl upper periphery of the bowl and including a supporting surface, wherein the overflow rim allows water to bypass the bowl when a water level of the bowl is above a predetermined level;

a non-vitreous overflow hose connecting the overflow rim to an outlet;

a bowl insert including a bowl insert upper periphery defining an opening; and a lip extending outward from the bowl insert upper periphery and supported by the supporting surface of the overflow rim at the bowl upper periphery.

2. The apparatus of claim 1, further comprising:

a pedestal shroud configured to be positioned over the bowl to conceal at least a portion of the bowl.

3. The apparatus of claim 2, wherein the shroud is formed from vitreous china.

4. The apparatus of claim 1, wherein the bowl insert is formed from vitreous china.

5. The apparatus of claim 1, further comprising:

a trapway opening defined by the bowl insert so that when the bowl insert is received within the bowl water passes from the bowl insert through the trapway opening of the bowl insert into a trapway for discharge.

6. The apparatus of claim 5, further comprising:

a seal disposed around the trapway opening between the bowl and the bowl insert to prevent water flowing between the bowl insert and the bowl.

7. The apparatus of claim 1, wherein the lip engages the overflow rim to prevent lateral movement of the bowl insert within the bowl.

8. The apparatus of claim 1, further comprising:

a removable tank shroud.

9. A flush engine comprising:

a bowl, formed from a non-vitreous material, comprising an opening at a bowl upper periphery and a sump at a lower portion of the bowl;

an overflow rim, formed from a non-vitreous material, at the bowl upper periphery of the bowl and including a supporting surface, wherein the overflow rim allows water to bypass the bowl when a water level of the bowl is above a predetermined level;

a non-vitreous overflow hose connecting the overflow rim to an outlet;

a bowl insert including a bowl insert upper periphery defining an opening; and a trapway opening defined by the bowl insert so that when the bowl insert is received within the bowl water passes from the bowl insert through the trapway opening of the bowl insert into a trapway for discharge.

10. The flush engine of claim 9, further comprising:

a seal disposed around the trapway opening between the bowl and the bowl insert to prevent water flowing between the bowl insert and the bowl.

11. The flush engine of claim 9, further comprising:

a lip extending outward from the bowl insert upper periphery and supported by the supporting surface of the overflow rim at the bowl upper periphery.

12. The flush engine of claim 11, wherein the lip engages the overflow rim to prevent lateral movement of the bowl insert within the bowl.

13. The flush engine of claim 9, further comprising:

a removable pedestal shroud configured to conceal at least the bowl.

14. The flush engine of claim 9, wherein the bowl insert is formed from vitreous china.

15. The flush engine of claim 9, wherein the bowl does not directly hold any fluid.

16. A method comprising:

providing a toilet assembly including a bowl, an overflow rim, an outlet, a first pedestal shroud and a first tank shroud, wherein the bowl does not directly hold any fluid;

removing the first tank shroud from a tank of the toilet assembly;

removing the first pedestal shroud from a flush engine the toilet assembly;

installing a second pedestal shroud on the flush engine the toilet assembly;

installing a second tank shroud on the tank of the toilet assembly; and connecting a non-vitreous overflow hose between the overflow rim and the outlet.

17. The method of claim 16, wherein the first tank shroud and the second tank shroud have a different aesthetic.

18. The method of claim 16, wherein the first pedestal shroud and the second pedestal shroud have a different aesthetic.

* * * * *